United States Patent [19]

Pike

[11] Patent Number: 4,757,295

[45] Date of Patent: Jul. 12, 1988

[54] TRANSMISSION LINE PULSED TRANSFORMER

[75] Inventor: Charles T. Pike, Lexington, Mass.

[73] Assignee: Avco Research Laboratory, Inc., Everett, Mass.

[21] Appl. No.: 97,047

[22] Filed: Sep. 16, 1987

[51] Int. Cl.[4] ..... H01F 15/04

[52] U.S. Cl. ..... 336/84 C; 336/69; 336/175; 336/180; 336/195

[58] Field of Search ..... 336/69, 70, 84 R, 84 C, 336/195, 180, 175, 212, 170

[56] References Cited

U.S. PATENT DOCUMENTS

| | | | |
|---|---|---|---|
| 1,907,633 | 5/1933 | Westermann | 336/70 X |
| 2,113,421 | 4/1938 | Camilli et al. | 336/70 X |
| 2,251,373 | 8/1941 | Olsson | 336/70 |
| 3,005,965 | 10/1961 | Wertanen | 336/195 |
| 3,028,569 | 4/1962 | Camilli et al. | 336/70 |
| 3,103,638 | 9/1963 | Greuet | 336/195 X |
| 3,356,931 | 12/1967 | Welty et al. | 336/180 X |
| 3,611,232 | 10/1971 | Sakamoto et al. | 336/170 |
| 3,781,639 | 12/1973 | Pesehel | 336/84 C X |
| 3,961,292 | 6/1976 | Davis | 336/195 X |

*Primary Examiner*—Thomas J. Kozma
*Attorney, Agent, or Firm*—M. E. Frederick

[57] ABSTRACT

A pulsed transformer capable of providing up to 500 kilovolt or higher, 10 nanosecond rise time, and 1000 joule or higher pulses comprising non-conducting or insulated transformer cores each separated by conductive grading rings wherein n coaxial cables in combination with the grading rings are connected in parallel at one end and in series at their other ends. The transformer may function as either an inverting or non-inverting transformer. In a transformer with n cables, if a pulse voltage of V is applied to the input, an output voltage of nV will appear at the output. The cores function to isolate the coxial cables and permit them to be connected in series at their one end. Weight may be minimized by operating the transformer in gaseous Freon rather than transformer oil.

8 Claims, 1 Drawing Sheet

TRANSMISSION LINE PULSED TRANSFORMER

This invention relates to transformers and more particularly to pulsed transformers for providing high voltage, high power pulses with extremely fast rise times.

BACKGROUND OF THE INVENTION

The generation of high voltage, extremely short pulses such as, for example, 500 kilovolt, 40 nanosecond pulses rules out many prior art devices and methods employed in pulsed laser and radar systems. Numerous patents have been issued and papers written on winding and other techniques that have been incorporated in the construction and operation of high voltage pulse transformers directed, for example, to high voltage transformers containing cores wound with high permeability grain orientated nickel-iron alloys, such as Supermendur and Deltamax, developed to reduce pulse transformer size, weight and losses. The principal restriction to the approach of using a single pulse transformer to generate trigger voltages and the like using these materials is their inherent leakage inductance, which precludes attaining pulse use times as short as 10 nanoseconds.

An alternate approach to generating such high voltage pulses having such rise times is the use of the well known Marx generator.

To generate such pulses with a Marx generator, one would have to provide a single, ten section Marx generator which would require a capacitance bank of 8 mf for a 500 kilovolt, 1 kilojoule pulse. The physical aspects of such components, inductance of capacitors and leads, make this approach impractical for applications requiring low weight and small volume. Further, such approaches are capable of delivering only about 10–100 joules with a risetime of at least 100–1000 nanoseconds, which represents a peak power of two to four magnitudes less than that of many present day requirements.

Still further, such approaches are totally incapable of providing the lightweight and reliability of systems required to operate in outer space.

SUMMARY OF THE PRESENT INVENTION

The present invention is a pulsed transformer capable of providing up to 500 kilovolt or higher, 10 nanosecond rise time, and 1000 joule or higher pulses comprising non-conducting or insulated transformer cores separated by conductive grading rings wherein n coaxial cables are connected in parallel at one end and in series at their other ends. The transformer may function as either an inverting or non-inverting transformer. In a transformer with n cables, if a pulse voltage of V is applied to the input, an output voltage of nV will appear at the output. The cores function to isolate the coaxial cables and permit them to be connected in series at their one end. Weight may be minimized by operating the transformer in gaseous freon $SF_6$ or other insulating gases rather than transformer oil.

BRIEF DESCRIPTION OF THE DRAWINGS

FIG. 2 is a schematic sectional view of a non-inverting pulse transformer in accordance with the invention.

DESCRIPTION OF THE PREFERRED IMBODIMENTS

Figure 7:
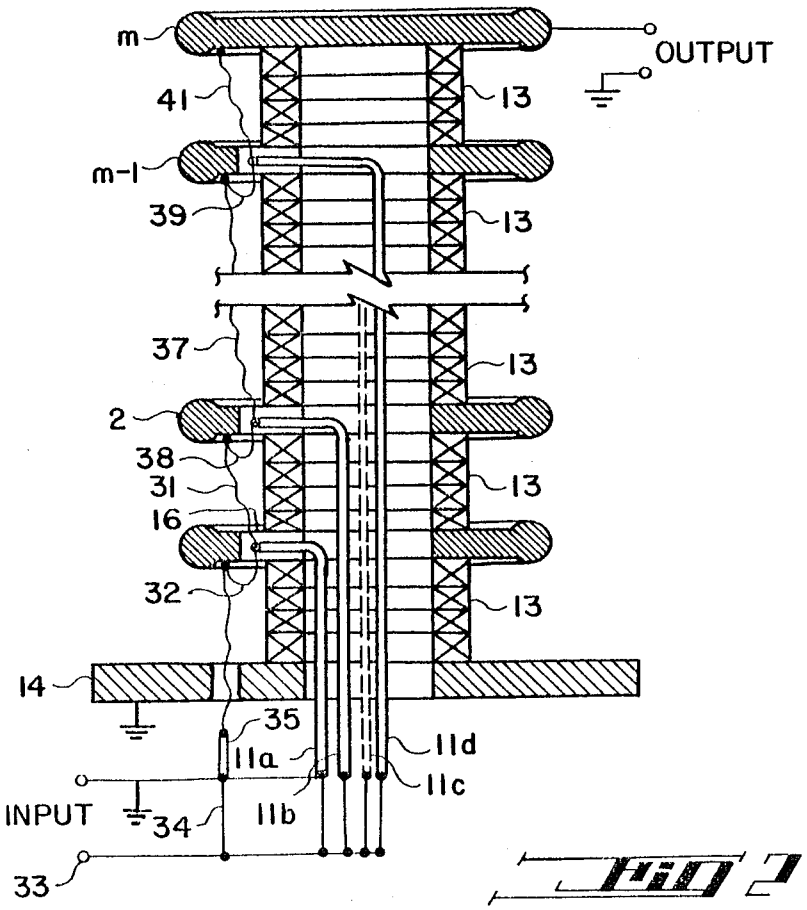
Figure 1:
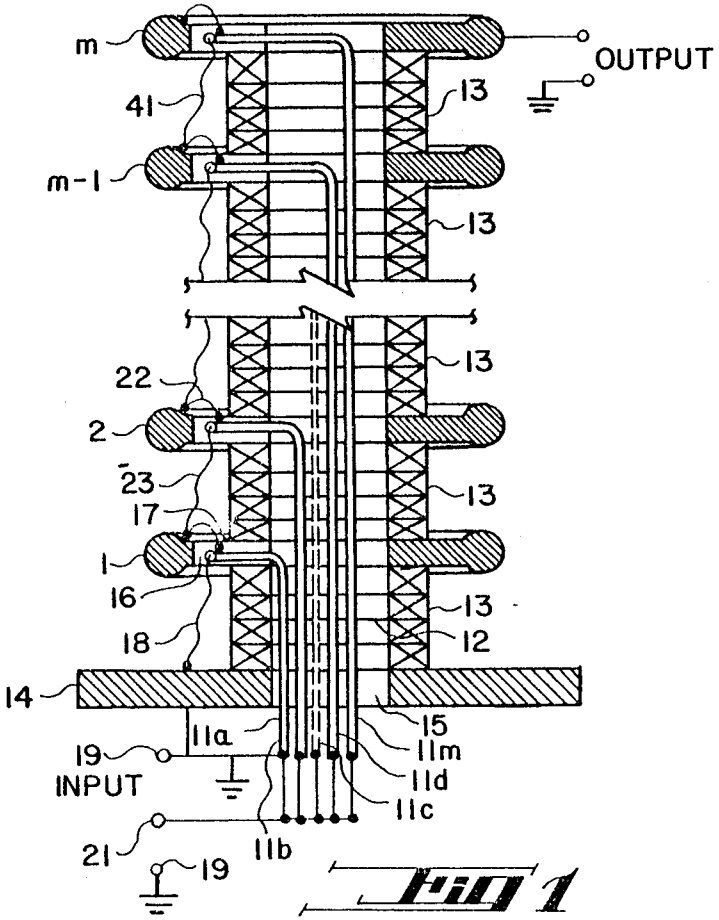
FIG. 1 is a schematic sectional view of an inverting pulse transformer in accordance with the invention.

Referring generally now to FIG. 1 there is shown a transformer in accordance with the present invention wherein a plurality of n coaxial cables 11*a*, 11*b*, 11*c*, 11*d* and 11*e* are connected in parallel at one end and in series at their other ends. This may be done (not shown) by putting isolating inductors in each cable. Such isolating inductors function to isolate the ends of the cables from each other for pulses for a voltage-time (Vt) product less than that required to saturate the core as shown by the equation:

$$\int V dt = \Delta BAN \times 10^{-8} \quad (1)$$

where V is the volage, t is the time, ΔB is the magnetic flux change, A is the cross sectional area of the core and N is the number of turns.

The simple approach noted above is, however, subject to the disadvantage that the full output voltage will appear across the isolating inductor for the cable at the top of the stack. The stepup (or stepdown) ratio is equal to the number of series cables in this approach.

FIG. 1 illustrates an embodiment of the present invention which overcomes the above noted disadvantage of having the full voltage across a single isolating inductor and in addition provides uniform grading for high voltages. The embodiment of FIG. 1 is inverting with respect to primary-secondary voltage polarity.

As shown in FIG. 1, n cables 11*a*, 11*b*, 11*c*, 11*d*, 11*n* pass through the central opening 12 of a first annular transformer core or group of annular transformer cores 13 mounted on an annular electrically conductive metal base plate 14. The transformer cores 13 may be comprised of non-conducting ferrite or be insulated metallic cores. For short pulses ferrite cores are preferred because the high frequency permeability is greater than for other core materials. The area A of such cores may be determined by the use of previously given equation (1) where:

$$V = 50\ kV,$$

$$t = 40\ \text{ns},$$

$$\Delta B = 3 \times 10^3\ \text{gauss}$$

and $$N = 1.$$

In addition to providing sufficient core area to prevent saturation of the cores, the inductance of the choke formed by the coaxial cable and cores must be high enough to prevent excessive current from flowing in the choke. If this current is limited to ≦10 percent of the total the required inductance, L, is:

$$L \geqq 10tZ$$

where t is the pulsewidth and Z is the cable impedance.

The required permability, μ, of the cores may then be calculated as follows:

$$\mu = \frac{Ll \times 10^9}{4\pi N^2 A}$$

where L, N and A are as previously defined and l=magnetic path length of the core=$2\pi r$ for a toroidal core where r is the average radius.

Returning now to FIG. 1, the first cable 11*a* passes through the central opening 15 in the base plate 14, the central openings 12 of the cores 13 and through an opening 16 in an annular conventional electrically conductive metallic grading ring 1. The electrically conductive shield 17 of the first cable 11*a* is electrically connected to grading ring 1 and the center conductor 18 is electrically connected to the base plate 14 which in turn is electrically connected to the grounded terminal 19 of the input signal terminals. The positive terminal 21 of the input signal terminals is connected in parallel at the input ends of each of the center conductors of the coaxial cables being used. Similarly, each of the shields of the coaxial cables at the input end are grounded as shown.

Disposed above and supported by grading ring 1 are further cores 13 which in turn support a further grading ring 2. The shield 22 of the second cable 11*b* is, similar to that of the first cable 11*a*, electrically connected to the second grading ring 2, and its center conductor 23 is electrically connected to the first grading ring 1. The provision of such additional cables as may be desired is designated by cable 11*c* shown in phantom and the break between grading rings 2 and n−1. The number of cables is determined by the amount of stepup or stepdown desired.

The provision of cores, grading rings and cables are repeated until the desired output voltage is obtained, a pulse of voltage +V at the parallel input connections providing an output pulse of −nV between the grounded base plate and the nth grading ring.

Weight may be minimized if the transformer of FIG. 1 is operated in gaseous Freon rather than transformer oil.

FIG. 2 shows a pulse transformer in accordance with the invention similar in construction to that of FIG. 1 with certain exceptions are more fully discussed below. The transformer of FIG. 2 illustrates a non-inverting embodiment which functions in a manner similar to that of FIG. 1 except that it provides an output voltage of +nV for an input of +V.

As shown in FIG. 2, the center conductor 31 of the first coaxial cable 11*a*, rather than being electrically connected to the base plate 14 as in FIG. 1, is electrically connected to the second grading ring 2. The shield 32 of the first coaxial cable 11*a* is electrically connected to the first grading ring 1 which in turn is electrically connected to the positive terminal 33 of the input signal terminals through the center conductor 34 of coaxial cable 35. The shield 36 of coaxial cable 35 is electrically connected to ground as is the base plate 14. Coaxial cable 35 as shown provides the first stage voltage. Since the embodiment shown in FIG. 2 is noninverting, the input voltage can be applied directly to the first stage through coaxial cable 35 as shown. The center conductor 37 of coaxial cable 11*b* is electrically connected to the next succeeding grading ring (n−1 for example), and its shield 38 is electrically connected to the second grading ring 2 which in turn is electrically connected to the shield of the first coaxial cable 11*a*. The shield 39 of the last coaxial cable 11*d* is connected to the penultimate grading ring n−1 which in turn is electrically connected to the center conductor 37 of the preceding coaxial cable. The center conductor 41 of the last coaxial cable 11*d* is connected to the last grading ring n.

The uppermost grading ring n in either embodiment as shown in FIGS. 1 and 2 may either have an opening as shown in FIG. 1 or be solid as shown in FIG. 2. The central opening 15 has been shown on a greatly enlarged scale for purposes of convenience of illustration. The central opening 15 need be only large enough to receive the desired number of coaxial cables and the coaxial cables can be of any suitable conventional design capable of carrying the maximum current flow and be able to stand off the input voltage and/or voltage per stage.

While any conventional core material may be used, such material should have sufficient permeability that the inductance generated by it is high enough to permit the desired voltage across such inductance to be generated.

While, as noted above, different core materials may be used, the cross sectional area of the core is a very important parameter. Thus, the cross sectional area of the core must have the permeability as noted above and in addition thereto, meet the requirements of Equation (1).

It is to be further noted that while in FIG. 2 (but not FIG. 1) core material is shown as separating grading rings n−1 and n, such is not a requirement. The last two grading rings (n−1 and n) need only be separated the desired distance by any satisfactory insulating material.

In a transformer as shown in FIG. 1 and FIG. 2, the magnitude of the capacitance formed by the grading rings may be adjusted either by changing the size of these grading rings or their relative spacing distances. Thus, if a greater capacitance is desired, the grading rings may be set closer together, or a material having a greater dielectric constant may be used to separate them.

Transformers in accordance with the present invention may have low output impedance such as, for example, 25 ohms impedance for a 100 joule pulse. For such a transformer, a low impedance stripline, such as, for example, one having an impedance of about 2.5 ohms, may be used to couple a pulser source to the transformer. Thus, if the stripline transmission line is made about 8 cm wide with a ground conductor sandwiched on either side of a center conductor the dielectric thickness d will be:

$$d = \frac{Z_o W \sqrt{E}}{60\pi}$$

where E is the dielectric constant of 2.3, W is the width of 8 cm and Z is the characteristic impedance of 2.5 ohms. This gives a d equal to 1.6 mm and a dielectric stress of about 800 V/mil which is within the capability of a wide range of available dielectrics.

Although there has been shown and described certain specific embodiments of the invention, it is to be understood that many modifications are possible. The invention, therefore, is not to be restricted except insofar as is necessitated by the prior art and by the spirit of the appended claims.

What is claimed is:

1. A pulsed transformer for generating pulses of output voltage having an amplitude n times the amplitude of the input voltage where n is one or more, comprising:

(a) an electrically conductive base plate generally annular in shape having a first central opening;

(b) a plurality of n annular transformer core means each having a second central opening and communicating with said first opening;

(c) a plurality of n annular shaped electrically conductive grading rings each having a third central opening, a grading ring being disposed between and separating adjacent transformer core means, said third openings communicating with said second openings;

(d) a plurality of coaxial cables each having an input end adjacent said base plate and an output end adjacent a different one of said grading rings, said coaxial cables extending through said central openings, each said coaxial cable having a continuous central conductor surrounded by electrically insulating material which in turn is surrounded by electrically conductive shield means;

(e) first and second input voltage terminals connected in parallel to said coaxial cable conductors and shield means at said coaxial cable input ends; and (f) third and fourth output voltage terminals, the central conductors and shield means of said coaxial conductors being interconnected at their output ends through said grading rings whereby they are connected in series to said output terminals.

2. A pulsed transformer as defined in claim 1 wherein one of said input terminals is connected to ground and to said base plate and to each of said sheild means and the other said input terminal is connected to each of said central conductors.

3. A pulsed transformer as defined in claim 2 wherein the output ends of each of said coaxial cables terminates adjacent a different one of said grading rings and its shield means is electrically connected to its said grading ring and its center conductor is electrically connected to the next succeeding grading ring, and said other input terminal is also electrically connected to the grading ring closest said base plate.

4. A pulsed transformer as defined in claim 3 wherein the center conductor of the coaxial cable terminating adjacent the penultimate grading ring is electrically connected to the last grading ring.

5. A pulsed transformer as defined in claim 4 wherein one of said output terminals is electrically connected to ground and the other terminal is electrically connected to the last grading ring.

6. A pulsed transformer as defined in claim 2 wherein the output ends of each of said coaxial cables terminates adjacent a different one of said grading rings and its shield means is electrically connected to its said grading ring and the center conductor of the next succeeding coaxial cable, and the center conductor of the coaxial cable terminating adjacent the grading ring closest said base plate is electrically connected to said base plate and ground.

7. A pulsed transformer as defined in claim 6 wherein the number of grading rings and coaxial cables is the same and the shield means of the last coaxial cable is electrically connected to the last grading ring.

8. A pulsed transformer as defined in claim 7 wherein one of said output terminals is electrically connected to ground and the other terminal is electrically connected to the last grading ring.

* * * * *